United States Patent [19]

Schellenberg

[11] 4,365,457

[45] Dec. 28, 1982

[54] CONTAINER CLOSURE

[75] Inventor: Walter Schellenberg, Diepoldsau, Switzerland

[73] Assignee: Max Sandherr AG, Switzerland

[21] Appl. No.: 143,463

[22] Filed: Apr. 28, 1980

[30] Foreign Application Priority Data

Jun. 18, 1979 [CH] Switzerland ..... 5674/79

[51] Int. Cl.[3] ..... B65B 7/28; B65B 61/18

[52] U.S. Cl. ..... 53/412; 53/487; 413/12

[58] Field of Search ..... 53/412, 487, 489; 220/258, 270, 276; 72/347, 348, 19; 113/120 XY; 493/156, 903; 413/12

[56] References Cited

U.S. PATENT DOCUMENTS

| | | | |
|---|---|---|---|
| 1,147,273 | 7/1915 | Sherbondy | 72/348 |
| 1,717,419 | 6/1929 | Steinmann | 72/348 |
| 3,136,469 | 6/1964 | Koenig | 220/270 X |
| 3,362,570 | 1/1968 | Geiger | 220/276 |
| 3,543,961 | 12/1970 | Kennedy | 220/273 |
| 3,707,133 | 12/1972 | Myer | 72/348 |
| 3,864,883 | 2/1971 | Koors et al. | 72/19 |
| 4,003,496 | 1/1977 | Ostrem et al. | 220/270 |
| 4,069,697 | 1/1978 | Morrison et al. | 72/19 |
| 4,088,242 | 5/1978 | Schellenberg | 220/258 |

FOREIGN PATENT DOCUMENTS

| | | | |
|---|---|---|---|
| 2061497 | 6/1972 | Fed. Rep. of Germany | 220/258 |
| 598063 | 4/1978 | Switzerland . | |

*Primary Examiner*—John Sipos

*Attorney, Agent, or Firm*—Roylance, Abrams, Berdo & Farley

[57] ABSTRACT

A seal and closure for a container end includes a metal foil seal having a cylindrical part sealed to the inner surface of the container adjacent the end, a transverse diaphragm part recessed inwardly from the end, and a tear tab on the diaphragm. An annular groove is formed in the cylindrical part between the container end and the diaphragm, the groove defining a tear line so that the membrane and the inward portion of the cylindrical part separate from the remainder thereof when the tear tab is pulled. An insertable lid covers the seal.

9 Claims, 5 Drawing Figures

CONTAINER CLOSURE

This invention relates to an improved container closure of the type including a lid and a recessed metal foil diaphragm having a tear-open tab fixed to the transverse diaphragm inside of the lid.

BACKGROUND OF THE INVENTION

A container closure of this general type is shown in Swiss Pat. No. 598,063 and U.S. Pat. No. 4,088,242. As shown therein, the closure has a desired separating line which has an inclined diaphragm portion parallel to the desired separating line which is formed with a groove-like cross sectional constriction the deformation thereof being able to compensate for deforming forces occurring in the diaphragm plane so that unintentional destruction can be avoided. However, it has been found that exceptional stresses applied to the container which can occur, for example, if the filled container drops on the floor with the lid raised and is compressed or crushed in the direction of the diaphragm plane, the deformation can be so great that, due to the inclined area, an adequate deformability is not present in the diaphragm plane and, instead, the diaphragm tears open at the line intended to be the desired separating line for opening the container.

BRIEF SUMMARY OF THE INVENTION

An object of the invention is to overcome this disadvantage so that the container closure is capable of absorbing larger dimensional changes or diameter enlargements due to deformation in the diaphragm plane without the diaphragm tearing open.

A further object is to provide a foil closure wherein the constricted or thinned area is located in the cylindrical part of the diaphragm sealed to the inside of the container wall. Thus, if large tensile forces occur in the diaphragm plane due to the unintentional deformation of the container, it is first necessary to detach part of the seal between the inside of the container wall and the cylindrical part of the membrane so that tearing open along the separating line only occurs if the detachment of the membrane from the inside of the container wall has advanced up to the desired separating line. By making the cylindrical part of the diaphragm correspondingly wide and by arranging the desired separating line adequately spaced from the diaphragm plane it is possible to create an adequate detaching path along the seal which can absorb such unintentional deformations of the container in the closure area.

German Auslegeschrift No. 2,061,497 discloses a container closure in which the diaphragm, after being stuck into the closure opening by its cylindrical portion, is provided with a circumferential cut which passes through the diaphragm and extends into the container body, which is normally cardboard, or into the container wall. On removing the diaphragm, the adhesive-bonded joint in the cylindrical diaphragm portion is detached from below up to the cut line. This container closure has the disadvantage that the adhesive-bonded joint in the cylindrical diaphragm portion up to the cut line does not suffice to form a reliable, i.e., gas tight, connection of the diaphragm to the container wall. As a result of the cut into the container body, the container contents can pass through the body material to the outside after a leak has occured in the adhesion area. These disadvantages are obviated by the container closure according to the invention because, in the event of detachment in the cylindrical diaphragm portion from the container all and up to the desired separating line, the line is still intact and is only destroyed by further force being applied.

In order to insure that the cylindrical diaphragm portion is not detached from the container wall beyond the desired separating line on opening the closure, it is advantageous for the seal between the cylindrical diaphragm portion located above the desired separating line to have a greater strength than in that cylindrical diaphragm portion disposed below, or inside, that line. This can be achieved by forming the seal in the upper cylindrical membrane portion with greater passing force against the inside of the container than is used in making the seal of the lower, or inside, cylindrical portion. A further significant advantage of the invention as compared with the subject matter of the aforementioned Swiss and U.S. patents is provided by the much better protection of the desired separating line in the foil because the corresponding foil area can be supported on the container body wall and is secured by sealing or adhering thereto. This advantage also permits the use of even thinner foil material than 0.08 milimeter, e.g., having a thickness of only 0.06 milimeters with a correspondingly further reduced thickness at the point of the cross-sectional constriction forming the desired separating line.

The production of the desired separating line and/or the stamping of the foil can take place in an inclined shoulder of the foil in accordance with the teachings of the Swiss patent and the foil, including the shoulder portion, is subsequently cylindrically shaped to correspond to the configuration of the inner surface of the container body. The force applied for production of the constriction to form the separating line can be limited by an electronic control utilizing a piezoelectric sensing device for electronically measuring the force that occurs.

Briefly described, the invention includes an improved container closure comprising a lid at least partially insertable into an end of a container and a metal foil seal of the type including a cylindrical portion adhered to the inner surface of the container, a diaphragm portion recessed inwardly from the container end and extending across the container interior, and a tear-open tab affixed to the diaphragm, the improvement wherein the foil seal includes means defining a groove-like circumferential region in said cylindrical portion between said diaphragm and the end of said container separating said cylindrical portion into a removable section and a permanent section whereby, when said tab is pulled to rupture and remove said diaphragm and open the container, said seal separates along said region to facilitate removal only of the seal portion inward of said region.

The invention also contemplates a method for producing a closure for a container comprising the steps of preforming a foil membrane into a cup-like shape having a generally cylindrical portion, a transverse wall at one end and an outward annular flange at the other end, forming an angular radially extending shoulder in said cylindrical portion and compressing the membrane material of said shoulder to a thickness significantly less than that of the adjacent membrane material, inserting the pre-shaped member into a tubular container with the flange overlying the container edge, and sealing the cylindrical portion to the interior wall of the container on both sides of the compressed shoulder and shaping the shoulder to the container wall.

In order that the manner in which the foregoing and other objects are attained in accordance with the invention can be understood in detail, particularly advantageous embodiments thereof will be described with reference to accompanying drawings, which form a part of this specification, and wherein.

DETAILED DESCRIPTION OF THE INVENTION

Figure 1:
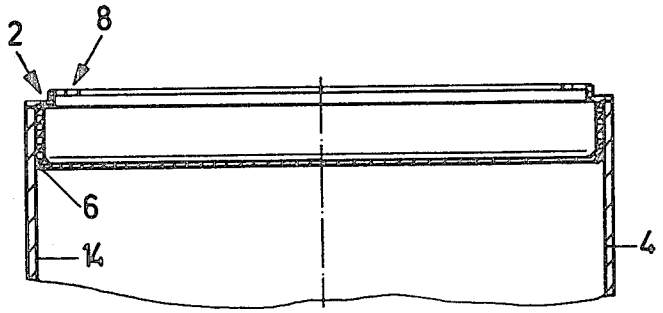
FIG. 1 is a partial side elevation, in section, through a container having a closure in accordance with the invention.
Figure 2:
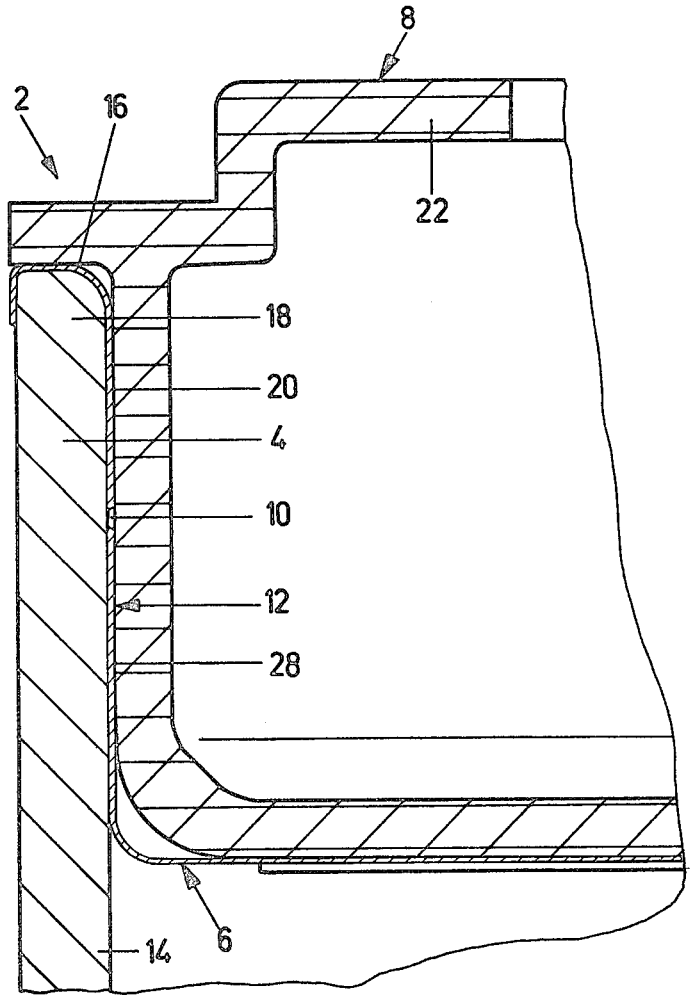
FIG. 2 is an enlarged fragmentary view, in section, of the container and closure of FIG. 1.

FIG. 1 and the enlarged fragmentary view of FIG. 2 show the finished container closure 2 including a metal foil membrane 6 attached to the container body 4 and including a detachably fitted lid 8. The closure includes a desired separating line 10 which extends circumferentially around the interior of the container body. It is particularly significant to note that the membrane closure includes a cylindrical portion 12 and that the desired separating line is an annular thinned or compressed portion which extends circumferentially around the cylindrical part and that the foil on both sides of the separating line is adhered to the inner surface 14 of container body 4 by heat sealing. The outer flange portion of foil of membrane 6 passes over the free end of the container, which is commonly a cardboard container cut from a cardboard tube, forming an edge protection 16 which prevents the raw edge of the cardboard 18 from being exposed. It is an important advantage that, after separating the removable portion of the membrane 6 up to the desired separating line 10 in order to open the container, the upwardly extending foil portion 20 together with the edge protection portion 16 remain on the container body so that the container edge and the inwardly adjacent area have a smooth and hygienically unobjectionable surface.

Figure 4:
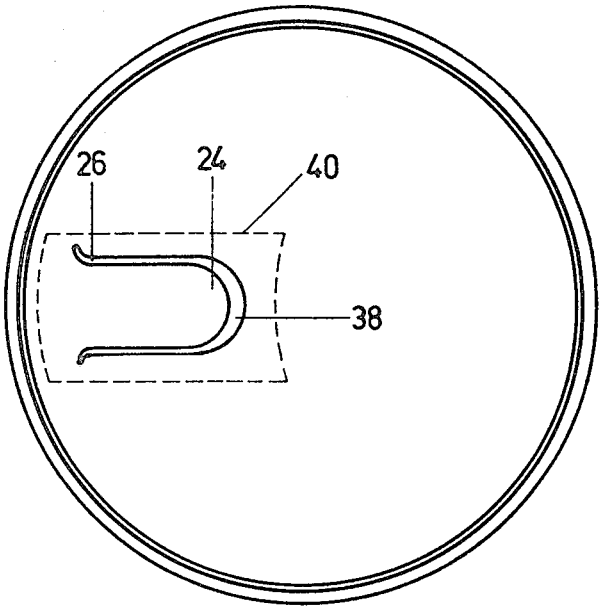
FIG. 4 is a plan view of the closure of FIG. 3.

The container lid 8 is constructed in a manner which is, per se, known and constitutes a type of lid commonly called a cup lid with an inwardly extending annular gripping flange 22. Before using the container or its contents, the lid 8 protects the foil membrane 6 against undesired damage or the like, particularly during transportation. The container closure is opened by first removing lid 8 and then by pulling upwardly on a gripping tab 24 which is attached to the diaphragm portion of the membrane which extends transversely across the interior of the container. As best seen in FIG. 4, the gripping tab is arranged between the diaphragm edge and the diaphragm center and its end 26 attached to the diaphragm is in the vicinity of the wall of the container body 4 such that the tearing-open movement is started at a circumferential point on the closure diaphragm and then continues in the circumferential direction. The cylindrical diaphragm portion 28 located below the desired separating line is detached, with the destruction of the seal and the internal coating on surface 14 of container body 4, up to the desired separating line 10 and, subsequently, that line separates so that detachment cannot continue upwardly into the cylindrical foil portion 20. This is also insured in that the seal of the upper cylindrical foil portion 20 is more firmly connected to the interior surface of the container body than the seal of the lower cylindrical foil portion 28.

Lid 8 can be made, for example, from a polymeric material such as polyethylene or the like. Aluminum is particularly suitable for use as the material for the metal membrane and diaphragm. Heat sealing between the surface of the foil and the internal coating on the surface 14 of container body 4 can be accomplished in a manner which is, in itself well known, by conventional holtmelt sealing.

Figure 3:
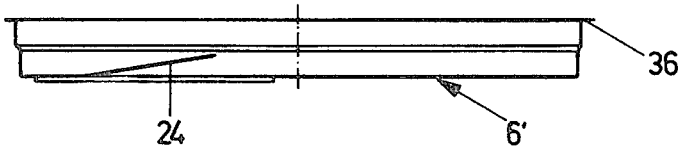
FIG. 3 is transverse sectional view of a foil closure before assembly with a container.
Figure 5:
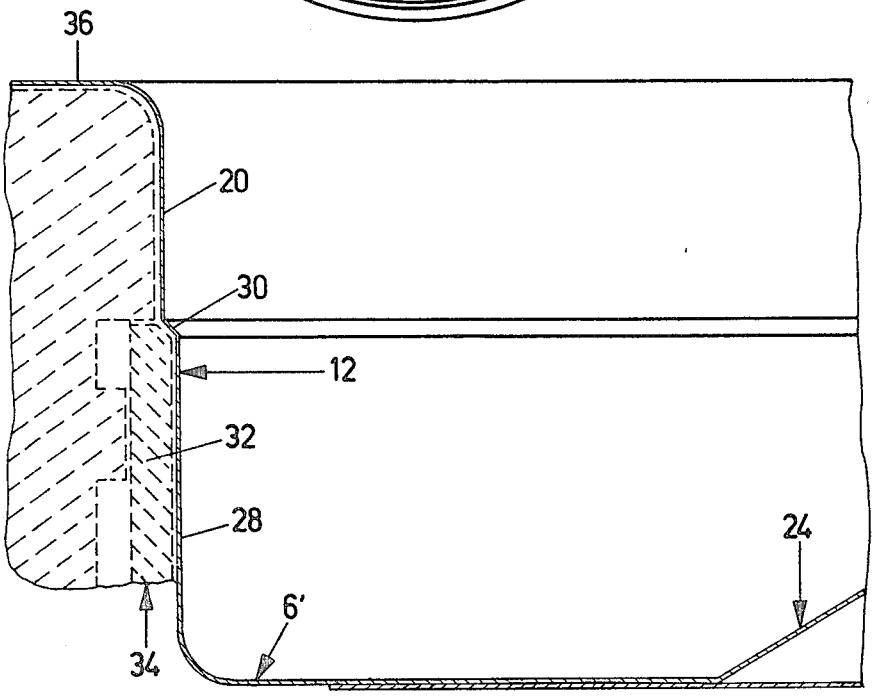
FIG. 5 is an enlarged fragmentary view, inside elevation of a portion of the closure of FIG. 3 showing a portion of a tool used in the manufacture thereof.

Referring now to FIGS. 3–5, it will be seen that the closure structure is preformed before joining to the container by deep drawing in a deep-drawing die so that it aquires the shape shown in FIGS. 3–5. In this preshaped closure structure 6', the upper cylindrical portion 20 is connected with the lower cylindrical portion 28 by an inclined shoulder 30 in which the membrane material has been compressed into a thinner cross section then in the adjacent membrane portions 20 and 28 due to compressing or squeezing of the material during the deep-drawing process. Thus, inclined area 30 forms the desired separating area after it has been shaped as shown in FIG. 2. However, the desired separating line can also be formed by a cross sectional constriction which is narrower than the inclined area 30.

To prevent squeezing or breaking through of the very thin metal of membrane 6', whose thickness is preferably about 0.06 millimeters during the material compression in the inclined area 30, preshaping into the shape shown in FIGS. 3–5 is carried out by a mold in which a separately movable mold member 32, indicated by broken lines in FIG. 5, engages on one side of inclined area 30. During the shaping process, an opposing force electronically controlable by means of a piezo electric device acts in the direction of arrow 34 on the movable mold member and acts counter to the deforming force exerted by the deep-drawing die (not shown) on the inside of the cup shaped diaphragm 6' in the inclined area 30. In this way, it is possible to precisely determine the size of the cross sectional constriction inside the desired separating line or in the inclined area 30 without there being any risk of the metal diaphragm being severed at this point during the preshaping thereof. The width of the inclined area forming the cross sectional constriction formed is, for example, less than 1 milimeter.

The cup-shaped metal diaphragm 6' preshaped in this way in accordance with FIGS. 3–5 is placed in the cylindrical container body cut from a tube so that the upper diaphragm flange 36 rests on the cut edge of the container body and projects laterally beyond the outside thereof. By introducing a shaped member approximately corresponding to the cup shaped metal diaphragm 6' into the diaphragm when it is fitted onto the container body, the diaphragm is given the shape shown in FIG. 2 in which the inclined area 30 engages on the inner surface 14 of the container body 4 and is sealed thereto. It will be apparent that, for this purpose, the shaped member is heated to an appropriate temperature for heat sealing. The shaped member (not shown) grips around the upper end 18 of container body 4 so that, in accordance with FIG. 2, the flanged portion 36 of the diaphragm is pressed around the container edge and, by an appropriate degree of pressure, a seal of the desired strength is obtained.

The shaping of the inclined area in the same plane as the cylindrical portions 20 and 28 of the metal diaphragm 6 can be accomplished by providing that the shaped member inserted into the diaphragm has, on its end facing the transverse diaphragm, a rounded configuration similar to the shape of the lower edge of lid 8. This rounded portion passes over the inclined area 30 and presses upwardly into the cylindrical configuration of the container.

The gripping tab 24 fitted to the top of the diaphragm can, for example, be constructed in accordance with the aforementioned Swiss patent and is cut from the diaphragm. The opening 38 resulting from the cut is closed by a foil portion 40 sealed or adhered against the bottom of the transverse membrane of diaphragms 6'.

While certain advantageous embodiments have been chosen to illustrate the invention it will be understood by those skilled in the art that various changes and modifications can be made therein without departing from the scope of the invention as defined in the apended claims.

What is claimed is:

1. A method for producing a closure for a container comprising the steps of preforming a foil membrane into a cup-like shape having a generally cylindrical wall with upper and lower substantially cylindrical portions, a transverse wall at one end and an outward annular flange at the other end; forming an annular radially extending shoulder between said upper and lower cylindrical portions of said cylindrical wall to offset said upper and lower portions from each other and compressing the membrane material of said shoulder to a thickness significantly less than that of the adjacent membrane material in said upper and lower portions;

inserting the preshaped membrane into a tubular container with the flange overlying the container edge;

shaping the shoulder and the cylindrical portion between the shoulder and the one end to conform to the container wall; and sealing the cylindrical wall to the interior wall of the container on both sides of the compressed shoulder and the outward annular flange to the container edge.

2. A method according to claim 1 wherein, during the step of sealing, the upper portion of the cylindrical wall between the shoulder and the flange is pressed more strongly against the container surface than the remainder thereof to obtain a stronger seal of said upper portion.

3. A method according to claim 1 wherein the membrane material of said shoulder is pressed flat over its entire width.

4. A method according to claim 3 wherein the width of said shoulder is no greater than 1.0 mm.

5. A method according to either of claims 1 or 3 wherein the preforming is preformed in a deep-drawing die having a forming member and a counter-shaping die member, and wherein the degree of compression of the shoulder is adjusted to a predetermined magnitude by limiting the force applied thereto by the counter-shaping member.

6. A method according to claim 5 wherein said counter-shaping die member includes a piezo electric force sensing element and wherein the applied force is electronically controlled in response to force sensed by said element.

7. A method according to claim 1 wherein the shoulder is preformed in a frusto-conical shape tapering downwardly and inwardly.

8. A method according to claim 1 wherein the foil membrane has a thickness of less than about 0.08 millimeters.

9. A method according to claim 1 wherein the foil membrane has a thickness of about 0.06 millimeters.

* * * * *